United States Patent [19]

Berndt et al.

[11] 4,200,265

[45] Apr. 29, 1980

[54] FURNACE FOR THE MELTING AND REFINING OF COPPER

[75] Inventors: Gerhard Berndt, Seevetal; Gerhard Kapell, Jesteburg; Anton Schummer; Jens U. Hansen, both of Hamburg, all of Fed. Rep. of Germany

[73] Assignee: Norddeutsche Affinerie, Hamburg, Fed. Rep. of Germany

[21] Appl. No.: 928,437

[22] Filed: Jul. 27, 1978

[30] Foreign Application Priority Data

Aug. 9, 1977 [DE] Fed. Rep. of Germany ..... 2735808

[51] Int. Cl.[2] ..... F27B 19/02

[52] U.S. Cl. ..... 266/212; 266/214; 266/215; 266/218; 266/225; 266/229; 266/901

[58] Field of Search ..... 266/201, 205, 212, 214, 266/215, 217, 218, 225, 227, 229, 900, 901; 432/159, 195, 198; 65/335, 346, 347

[56] References Cited

U.S. PATENT DOCUMENTS

| | | | |
|---|---|---|---|
| 1,032,745 | 7/1912 | Dow | 266/212 |
| 1,682,343 | 8/1928 | Lanigan | 266/212 |
| 1,948,696 | 2/1934 | Brassert et al. | 266/212 |
| 2,021,245 | 11/1935 | Tonnar | 432/195 |
| 3,171,877 | 3/1965 | Thring | 266/162 |
| 4,033,562 | 7/1977 | Collin | 266/901 |

FOREIGN PATENT DOCUMENTS 2062144 12/1972 Fed. Rep. of Germany .

*Primary Examiner*—L. Dewayne Rutledge
*Assistant Examiner*—John P. Sheehan
*Attorney, Agent, or Firm*—Karl F. Ross

[57] ABSTRACT

A furnace for the melting and refining of raw copper and/or blister copper comprises a shaft furnace having a lock-chamber feeder for the material at the top of the shaft furnace and an opening into a hearth furnace in which the copper is refined. The shaft furnace and the hearth furnace are constructed unitarily with one another with the shaft furnace surmounting the hearth furnace in such manner that, when the apparatus has been charged, a pile of copper is formed which is supported on the bottom of the hearth furnace and slopes toward a portion of the length of the hearth furnace.

10 Claims, 9 Drawing Figures

FURNACE FOR THE MELTING AND REFINING OF COPPER

FIELD OF THE INVENTION

The present invention relates to a furnace for the melting and refining of copper and, more particularly, to an apparatus for smelting (melting) and refining raw copper and blister copper.

BACKGROUND OF THE INVENTION

A variety of furnaces has been used heretofore for the smelting and/or refining of cooper either in the form of so-called raw copper or so-called blister copper.

For example, in addition to electric furnaces and reverberatory furnaces for this purpose, it has been proposed to provide shaft furnaces in association with hearth furnaces.

As has been described in the printed German application (Auslegeschrift) DT-AS 2,062,144, for example, copper can be melted in the shaft furnace and can be transferred through a tap into one or more reverberatory furnaces or tilting furnaces.

The molten copper may also be transferred into furnaces which are connected in series and in which the copper is blown with air to remove the impurities. Then the copper is treated with a poling gas which controls the oxygen content.

The smelting of raw copper or blister copper in the shaft of the furnace has a significant disadvantage in that the lining of the furnace may be subjected to excessive wear because of its contact with the molten slag.

Furthermore, the burners must generally be operated at a pressure substantially in excess of atmospheric pressure while the copper pile in the region of the melting zone has a low and often nonuniform permeability to gas.

OBJECTS OF THE INVENTION

It is the principal object of the present invention to provide an improved apparatus for the smelting and refining of raw copper and blister copper whereby disadvantages of earlier systems are avoided and the cost of the apparatus is reduced by comparison with earlier systems.

Still another object of the invention is to provide an improved method of operating an apparatus for the melting and refining of copper.

Still a further object of the invention is to provide an improved furnace for the melting and refining of raw copper and blister copper which can be operated with greater efficiency than earlier shaft furnace systems.

SUMMARY OF THE INVENTION

These objects and others which will become apparent hereinafter are attained, in accordance with the present invention, in a furnace for the melting and refining of copper which comprises a shaft furnace portion and a hearth furnace portion, both of these portions being constructed unitarily with one another and the shaft furnace portion surmounting the hearth furnace portion so that, when the apparatus is charged with copper, a copper pile is formed on the bottom of the hearth furnace and slopes toward a portion of the hearth furnace chamber disposed outside the projection of the shaft furnace upon a horizontal plane.

According to an essential feature of the invention, burners are provided in a transition region between the shaft furnace and the hearth furnace and are directed toward the slope of the copper pile.

Finally, according to yet another feature of the invention, the hearth furnace is provided with known elements of the apparatus which are required for optimum metallurgical design.

Because of this construction of the apparatus, the copper pile, which is supported by the bottom of the hearth furnace, is isolated at least in part below the shaft furnace so that the melting process can take place substantially at this self-supporting pile so that the molted charge does not contact the walls of the shaft furnace under conditions in which significant wear may be expected.

According to the invention, the wall of the shaft furnace can include an angle of about 90° with an arched roof of the hearth furnace, as seen in the longitudinal direction or along the axis thereof. As a consequence, burners which can be directed toward the sloping copper pile can be mounted in the arched roof of the hearth furnace.

According to yet another feature of the invention, the shaft furnace is so designed that its lower portion is constituted as a downwardly flaring transitional cone at least on that side at which the hearth furnace extends out of the projection of the shaft furnace. The outward flare is such that it permits the formation of a slope but with an included angle not in excess of 70°.

The burners can be mounted in the transitional cone. Because of this configuration, the burners can act on a long sloping surface so that a high melting rate is assured.

We have, most surprisingly, found that we are able to increase the melting rate still further by providing the lower portion of the shaft furnace as a transitional cone throughout its periphery and by connecting it to the hearth furnace in a structural unit therewith so that the copper pile which forms below the shaft furnace can slope to the horizontal on all sides.

In the latter case, only a small increase of the size of the hearth furnace adjacent the shaft furnace will enable the use of a greater number of burners than is the case with the embodiment previously described and will increase the melting surface area, thereby more than doubling the melting rate.

Furthermore, in the latter system, there is a generally annular free space between the copper pile and that portion of the hearth furnace that is close to the pile so that the molten charge can flow down freely through this space.

To prevent contact between newly formed slag and the brick lining of the hearth furnace in the melting region, we have found it to be advantageous to provide in the region of the surface of the molten material a protective layer of solidified slag.

The provision of this protective layer can be accomplished by disposing cooling members at an appropriate level in the wall of the hearth furnace.

The formation of the protecting layer may be promoted by an appropriate adjustment of the burners. Alternatively, the formation of a suitable protecting layer can be induced by a proper adjustment of the burners.

One need not be concerned with the wear of the brick lining on other portions of the hearth furnace wall because our experiments have shown that there is almost no attack on the brick lining of the furnace in these other portions since there is virtually no relative movement of the slag and the wall of the hearth furnace along these regions.

According to an important feature of the invention, the transitional cone can be constituted of segments, each of which is provided with at least one burner. For instance, where the transitional cone occupies the entire periphery of the lower portion of the shaft furnace, it may be assembled from eight segments. These segments, together with the respective or associated burners, can be replaced quickly without the need for running the shaft furnace until it is empty. It is sufficient, to shut down a segment, to close off its burner or burners.

According to yet another feature of the invention, the burners disposed in the transitional-cone region can be pivotally mounted so that the melting step can be caused to proceed in a controlled and particularly uniform manner along the pile.

If the melting process can be watched through openings in the wall of the hearth furnace, an appropriate adjustment of the burners can be effected in a simple manner. In this embodiment, it is possible to effectively process charges whose nature is not fully or sufficiently known because appropriate adjustment of the burners can be made through monitoring of the melting process.

Naturally, there is no need for pivotal mounting of the burners if the properties of the charge and the operating conditions are sufficiently known, e.g. from parallel-operating apparatus or from other experiences (empirical or otherwise) with the material of the charge.

According to yet another feature of the invention, one or more preheating burners can be provided in the lower portion of the shaft furnace. The hot flue gases which are delivered by the transitional region burners deliver sensible heat to the pile of copper as they flow upwardly through the shaft furnace, and these preheating burners permit the development of the copper temperature to any desired degree, thereby enabling the preheating of the raw or blister copper to temperatures which can be close to the melting point thereof.

Unlike conventional melting burners disposed in the furnace shaft, the preheating burners of the present invention do not create problems or pose difficulties because they do not result in melting and hence there can be no deleterious contact between the slag and the brick lining of the shaft furnace. The preheating burners may be arranged in one or two rows.

We have also found that it is highly advantageous to provide, in the shaft furnace of the present invention, a suction fan to provide the draft, the suction fan acting via control means and having an effect on the draft as low as at the hearth furnace.

This expedient allows the pressure or subatmospheric pressure in the hearth furnace to be adjusted within wide limits and the gas velocity in the hearth furnace to be controlled in a technologically and economically desirable manner.

According to still another feature of the invention, the molten copper can be subjected to the desired or required metallurgical processes in that portion of the hearth furnace which is disposed below and laterally offset from the plan configuration of the shaft furnace in projection on a horizontal plane.

To permit various processes to be carried out, e.g. in continuous operation, the hearth furnace is provided with at least one siphon-like partition and is disposed adjacent to the shaft furnace with nozzles or lances for feeding oxidizing gases, generally air or oxygen-enriched gas, high-oxygen gas or technologically pure oxygen, to the shaft furnace.

As a result, impurities contained in the molten copper can be caused to enter the slag which can be removed or recovered through suitable openings.

When nozzles or lances are provided for feeding reducing gases into that portion of the hearth furnace disposed behind the partition, any metallurgical treatment desired may be carried out so that copper having properties which can be varied within a wide range can be produced.

Controllable exhaust blowers (evacuating blowers) may be used to induce the gas to flow along separate paths or to transfer the exhaust gas from the poling process into the blowing zone of the hearth burners so that the energy content is used by after burning.

Openings are provided in the hearth furnace to permit manipulation of the slag and to allow an overflow of the molten material. Advantageously, the means provided at these openings or in association therewith are designed such that the surface level of the molten material can be varied.

The slag can be removed intermittently or continuously and, if desired, after one or more fluxing agents has been introduced. The copper can also be intermittently or continuously removed and conducted away, e.g. by a casting trough into which the hearth furnace opens.

When necessary or desirable, the hearth furnace of the present invention can be supplied with molten copper from a source such as a copper converter, the molten copper being subjected to any requisite metallurgical process jointly with copper which has been smelted in the shaft furnace.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1A:
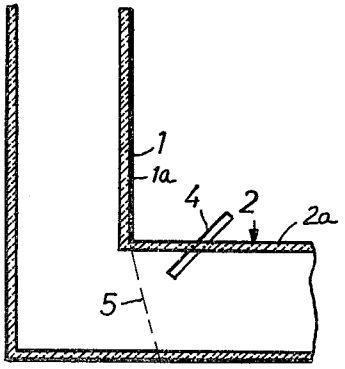
FIG. 1A is a vertical cross-sectional view diagrammatically illustrating the assembly of FIG. 1, the cross-sectional view being taken generally along the line IA—IA of FIG. 1.
Figure 1:
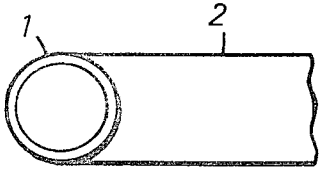
FIG. 1 is a diagrammatic top plan view of a combination of a hearth furnace and shaft furnace illustrated diagrammatically.

In FIGS. 1 and 1A, there is shown a shaft furnace 1 which surmounts a hearth furnace 2 and extends upwardly at one end of the latter.

The top of the hearth furnace, shown as the roof 2*a*, is vaulted or arched but forms a right angle (90°) with the vertical wall 1*a* of the shaft 1 at the junction between them. The diametrically opposite portion of the shaft wall extends downwardly to the floor 2*b* of the hearth. Both the shaft and the hearth are formed unitarily with one another, i.e. with a refractory lining which extends continuously over the interior of both the shaft and the hearth. Any conventional shaft design can be used above its junction with the hearth furnace and to the right of the junction of the hearth furnace and the shaft, any conventional shaft furnace design can be employed.

Figure 2A:
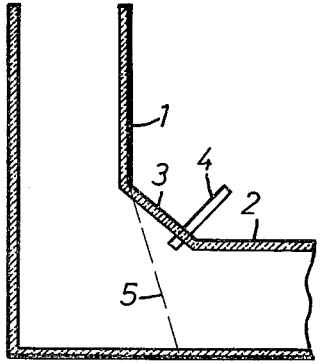
FIG. 2A is a cross-sectional view taken along the line IIA—IIA of FIG. 2.
Figure 3A:
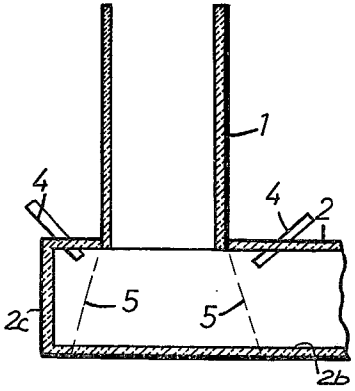
FIG. 3A is a cross-sectional view taken along the line IIIA—IIIA of FIG. 3.
Figure 4A:
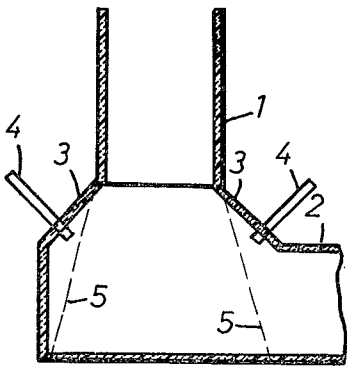
FIG. 4A is a cross-sectional view taken along the line IV*a*—IV*a* of FIG. 4.
Figure 2:
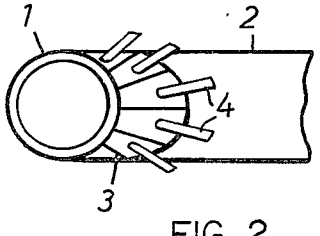
FIG. 2 is a view similar to FIG. 1 but illustrating the system in which the conical transition region is at least in part segmented.
Figure 3:
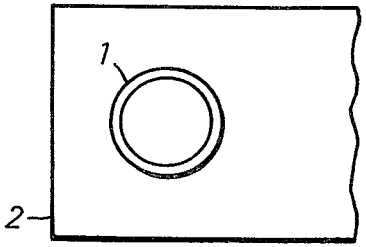
FIG. 3 is a view in which the pile of copper has a conical configuration and extends all around the axis of the shaft.

Since corresponding reference numerals are used in the remaining figures, it will be apparent from FIGS. 2 and 2A that the shaft 1 can be connected with the hearth furnace 2 by a transitional conical segment 3. In this embodiment it will be apparent, especially by comparison with that of FIGS. 1 and 1A, that the hearth furnaces can have the same height although the slope of the pile of copper material to be smelted, shown at 5, can be greatly increased. The broken line 5 represents the side of the pile, i.e. the slope, and symbolizes the melting surface which is available and can be subjected to the heat from burners trained on these flanks of the pile. The melting surface for a given slope 5 is determined by the width of the hearth furnace.

In the embodiments of FIGS. 3 and 3A and FIGS. 4 and 4A, the shaft furnace is mounted upon the hearth furnace somewhat inwardly from its end 2*c* with or without the transitional cone 3 so that the isolated copper pile can be formed on the floor 2*b* of the hearth furnace with slopes on all sides. In other words, the pile which descends from the shaft onto the floor of the hearth furnace has all-around clearance from the walls of the hearth. Obviously in this case the combination of the slope and the diameter of the pile determines the melting surface area.

In all of the embodiments, burners 4 are trained toward the sloping surface 5 of the copper pile.

Figure 4:
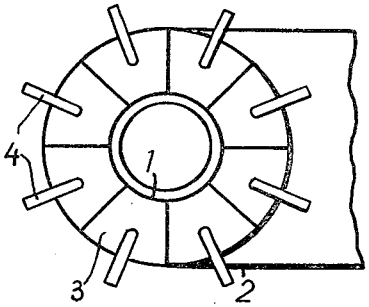
FIG. 4 is a view similar to FIG. 3 in which a segmented complete peripheral conical transition piece is provided.

As can be seen from FIGS. 2 and 4, the transitional cones may be provided with respective burners 4, each of which can be provided in a respective segment from which the transitional cones can be assembled.

Figure 5:
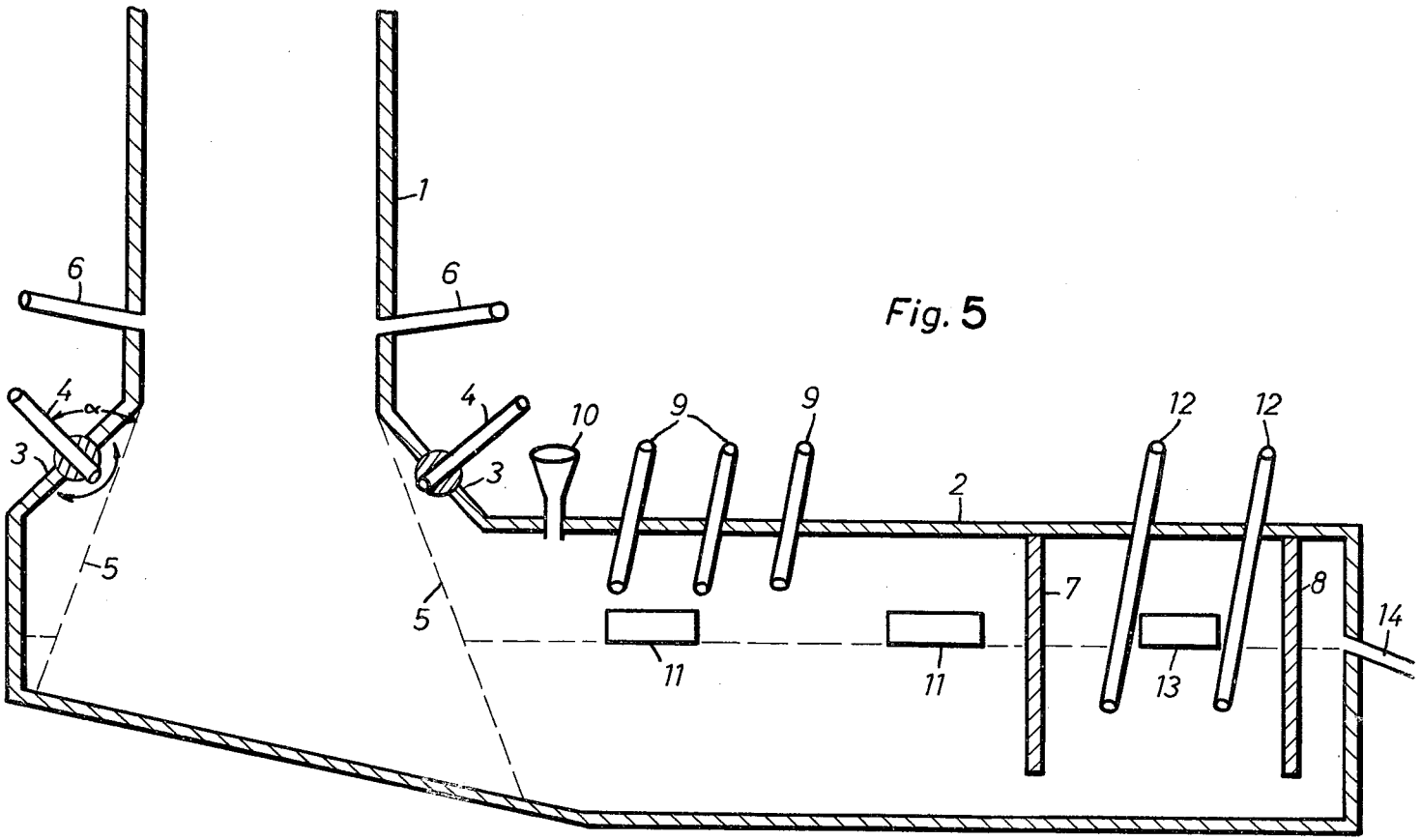
FIG. 5 is a cross-sectional view in greater detail illustrating the apparatus which has been shown partly diagrammatically in FIGS. 4 and 4A.

The principles of operation of the apparatus of the present invention will be clearly apparent from FIG. 5. The apparatus shown in this figure has a shaft furnace 1 and a hearth furnace 2 connected by the transitional cone 3 in the configuration previously described in connection with FIGS. 4 and 4A. The shaft furnace, the transitional cone and the hearth furnace form a single structural unit, i.e. are formed unitarily with one another.

The inclined burners 4 of the transitional cone can be perpendicular to a generatrix thereof and can be inclined at an acute angle to the slope 5 of the copper pile. This acute angle, included between the flank of the pile and the axis of the pipe with its vertex turned downwardly, can range between 45° and 90°.

Preheating burners 6 are provided within the shaft furnace above the copper pile and hence above the transitional cone 3 for preheating the raw copper or blister copper. The rising gases in the shaft furnace also bring about a preheating action.

The hearth furnace 2 is subdivided into three regions by siphon-forming partitions 7 and 8. The main region, formed between partition 7 and the pile 5, is provided with blowing lances which are trained upon the surface of the melt. These blowing lances 9 are used to promote the reaction of the melt to form a slag whereby impurities are extracted from the melt. A slag-forming substance can be added through the feeder 10 by conventional techniques and the slag layer is removed through suitable overflow openings 11.

In the shorter region between the partitions 7 and 8, lances 12 are used to feed the poling gas into the melt, these lances being immersed therein. The poling gas, as is the case with most poling procedures, serves to control the oxygen content. A further overflow opening 13 is provided in this region of the hearth furnace to enable the withdrawal of any additional slag which may form atop the melt.

Pure copper is tapped from the furnace through an outlet chute 14 which opens into the final compartment formed between the partition 8 and the wall of the hearth furnace distal from the shaft 1.

The charging lock chamber, suction fans and the like commonly used in the shaft furnace have not been shown since they are conventional in the art. Various auxiliary devices to open and close the overflow devices, valves and the like have also not been illustrated since they too are conventional in the art.

In the cases in which a transitional cone is provided, the apex angle thereof is substantially greater than the apex angle of the flanks of the conical pile which is formed. This ensures a spacing of the walls of the furnace from the flanks of the pile to enable heating over the entire exposed area of the pile.

Preferably, however, the included angle of the transition zone does not exceed 70°. As can be seen from FIG. 5, moreover, each of the burners 4 can be pivotally mounted at 5 on the apparatus structure to enable the angle $\alpha$ to be varied as required.

What is claimed is:

1. An apparatus for melting and refining copper, comprising:

a hearth furnace having a discharge side;

a shaft furnace surmounting said hearth furnace remote from said discharge side and formed unitarily with said hearth furnace, said shaft furnace being disposed relative to said hearth furnace such that a copper pile is formed on the bottom of the hearth furnace below the shaft furnace and slopes toward a portion of the hearth furnace disposed outside the vertical projection of the shaft furnace on the bottom of the hearth furnace;

a downwardly extending partition dividing said hearth furnace into two portions between said shaft furnace and said discharge side;

burners in the region of the junction between the shaft furnace and the hearth furnace and trained upon at least one flank of the copper pile formed on the bottom of the hearth furnace;

means provided between said partition and said pile for feeding an oxidizing gas into one of said portions proximal to said shaft furnace; and means for introducing a poling gas into a melt of copper in said hearth furnace in the portion on the opposite side of said partition and distal from said shaft furnace.

2. The apparatus defined in claim 1 wherein said region is formed as a downwardly flaring transition cone at least on a side of the shaft furnace at which the hearth furnace extends away from the projection of the shaft furnace, the flare of the transition cone being such that it has an included angle not in excess of 70°, said burners being mounted in the transition cone.

3. The apparatus defined in claim 2 wherein said shaft furnace is connected all around its periphery with such a transition cone.

4. The apparatus defined in claim 2 wherein said transition cone is constituted of segments each of which is provided with a respective burner.

5. The apparatus defined in claim 1 wherein said burners are pivotally mounted on the apparatus.

6. The apparatus defined in claim 1, further comprising preheating burners opening into said shaft furnace above the burners in said region.

7. The apparatus defined in claim 1 wherein the shaft furnace is provided with a suction fan acting via control means and having an effect on the draft as low as at said hearth furnace.

8. The apparatus defined in claim 1 wherein the means provided between said partition and said pile for feeding said oxidizing gas include lances.

9. The apparatus defined in claim 8 wherein lances for feeding reducing poling gas are provided on the opposite side of said partition.

10. The apparatus defined in claim 1 wherein the means provided between said partition and said pile for feeding oxidizing gas includes nozzles.

* * * * *